United States Patent [19]

Goussios

[11] 4,244,105

[45] Jan. 13, 1981

[54] POLYTRACK DIGITAL SCALE

[76] Inventor: Constantine C. Goussios, 37 Chaffee Ave., Albertson, N.Y. 11507

[21] Appl. No.: 883,631

[22] Filed: Mar. 6, 1978

[51] Int. Cl.[2] ..... B43L 7/00

[52] U.S. Cl. ..... 33/1 M; 33/419; 33/450

[58] Field of Search ..... 33/1 M, 125 M, 95, 81, 33/110, 76 R, 79 R, 75, 103, 108

[56] References Cited

U.S. PATENT DOCUMENTS

| | | | |
|---|---|---|---|
| 1,010,664 | 12/1911 | Melick | 33/81 |
| 1,057,583 | 4/1913 | Schenk | 33/95 |
| 1,213,664 | 1/1917 | McCuaig et al. | 33/81 |
| 3,449,833 | 6/1969 | Dzula | 33/1 M |
| 3,688,410 | 9/1972 | Zeidler et al. | 33/125 M |
| 3,757,422 | 9/1973 | Frydenberg | 33/76 R |
| 3,973,326 | 8/1976 | Gallacher et al. | 33/1 M |

FOREIGN PATENT DOCUMENTS

| | | | |
|---|---|---|---|
| 338648 | 6/1921 | Fed. Rep. of Germany | 33/110 |
| 911950 | 12/1962 | United Kingdom | 33/125 M |

*Primary Examiner*—Richard E. Aegerter

*Assistant Examiner*—John W. Shepperd

[57] ABSTRACT

A digital scaler for measuring and displaying a distance on a drawing surface comprising a first triangle with a verticle straight edge and a second triangle with a horizontal straight edge slightably engaged with the first triangle along the vertical straight edge. A drive in the form of a drive wheel and pulleys are connected between the first and second triangles and can be activated to displace the second triangle with its horizontal straight edge along the vertical straight edge of the first triangle. A horizontal displacement measuring device is connected to the first triangle and engageable with the drawing surface to measure the linear displacement of the first triangle when it is drawn horizontally across the drawing surface. A vertical displacement measuring device is connected to the drive wheel and measures the displacement of the second triangle along the vertical straight edge of the first triangle when the drive wheel is rotated. An electronic digital display can be connected to the horizontal and vertical displacement measuring devices to display the horizontal and vertical displacements of the vertical and horizontal straight edges respectively.

7 Claims, 5 Drawing Figures

POLYTRACK DIGITAL SCALE

BACKGROUND OF THE INVENTION

1. Field of the Invention

This is an improvement of a previous application filed by the inventor on Feb. 9. 1977, entitled Universal Drafting Triangle with Ser. No. 766,877 now U.S. Pat. No. 4,121,344. The present invention refers in general to drafting tools and in particular to a new and useful digital measuring device for visually displaying the displacement of a vertical straight edge and a horizontal straight edge of the device over a drafting surface.

2. Description of the Prior Art

In the inventor's previous application for a UNIVERSAL DRAFTING TRIANGLE, which is incorporated by reference in this application, there is described a drafting aid which replaces the functioning of a T-square and triangle arrangement on the conventional drafting table with a single integrated unit which comprises a first right triangle member which can be placed upon and be slid along a conventional T-square or parallel straight edge which is provided on most modern drafting tables. This first triangle provides a vertical straight edge which can be utilized in a conventional manner to draw vertical parallel lines on a drafting surface. A second triangular member is engaged with the first triangle and slidable along its vertical edge. A drive means which comprises a hand operable wheel is mounted in the first triangle and connected to the second triangular member so that a draftsman may manipulate the drive wheel by rotating it in one direction or the other, thereby raising or lowering the second triangular member with respect to the first triangle. The top edge of the second triangular member is provided in parallel orientation to the T-square or parallel straight edge on the drafting table and through the manipulation of the drive wheel, a draftsman using one hand can raise or lower the striaght edge of the second triangular member and draw a series of parallel horizontal lines. The entire system, therefore, enables a draftsman to draw horizontal as well as vertical parallels using one hand to engage, hold and manipulate the device, and thereby leave the other hand to do the actual drawing. The Universal Drafting Triangle therefore provides a single drafting tool that reduces the amount of manipulation requried in aliging various drafting tools which were previously required to draw any number of lines on a drafting surface.

As with any conventional drafting tool the Universal Drafting Triangle can be provided with scaled markings to indicate distances on both its horizontal and vertical straight edges. By reading off markings a draftsman can, in a conventional manner, mark off, for example, equally spaced vertical or horizontal lines. Such a conventional method of marking positions on a drafting surface results in eye strain as well as opens the door to incorrect interpretations of markings and graduations on the scale which are unavoidable after long hours of drafting. Further complications arise when the scale on a drawing must be changed or where a drawing must be made from other drawings of a different scale. At the present time draftsman are also faced with the conversion of changing drawings scales from the English measuring system to the metric system. Although such a conversion requires a simple multiplication of one unit of measure by the other, such a conversion results in the numerical values of distances and scales being entirely different in one system from that in another. A draftsman, therefore, loses any simple relationship he might be able to utilize in converting a drawing from one system to the other. For example, a drawing which must be reduced in scale from one inch equals one foot to ¼ inch equals one foot can simply visualize the conversion by quartering any measurement he takes from the drawing to be copied. When converting from English to metric, however, the draftsman must multiply his English measurements by a fractional number which at best is approximate and which is difficult if not impossible to visualize quickly.

SUMMARY OF THE INVENTION

The present invention is intended to overcome the past difficulties of scaling whether used with convensional drafting tools or in conjunction with a device like the UNIVERSAL DRAFTING TRIANGLE.

An object of the present invention is to provide a digital display scaling device which can be used in conjunction with the device similar to the Universal Drafting Triangle to digitally display a distance on a drafting surface over which a vertical or horizontal straight edge of the Universal Drafting Triangle has traveled. The distance can be measured off in inches, millimeters, or any designated unit and an electronic means may be provided for changing the scale so as to display fractions of the unit selected.

In the use of a conventional graduated scale, a draftsman must look ever more carefully at the fractions of graduations in order to read an accurate distance on a drafting surface. With increased accuracy, a draftsman is required to discern differences in ever shrinking units until inaccuracies must necessarily result. By using a digital display a draftsman can easily and quickly see any distance measured off on the drafting surface to any desired accuracy. Regardless of the minuteness of the graduations to be measured, the draftsman will be presented with a display of constant size and no reduction of accuracy will result when smaller graduated distances are read. In addition to increasing the accuracy and readability of dimensions on a drawings surface, the overall speed at which a draftsman can proceed is also drastically increased.

Accordingly, an object of the present invention is to provide a digital scaler for measuring and displaying a distance on a drawing surface comprising, a vertical straight edge means having a vertical straight edge, a horizontal straight edge means having a horizontal striaght edge slidably engaged with said vertical straight edge means, drive means connected between said vertical straight edge means and said horizontal straight edge means for driving said horizontal straight edge means along said vertical straight edge of said vertical straight edge means to vertically displace said horizontal straight edge, horizontal displacement measuring means connected to said vertical straight edge means and engageable with the drawing surface for measuring a horizontal displacement of said vertical straight edge means on said drafting surface, vertical displacement measuring means connected to said drive means for measuring a vertical displacement of said horizontal straight edge when said drive means drives said horizontal straight edge means along said vertical straight edge, and digital display means for displaying a digital readout corresponding to said horizontal and vertical displacements.

Another object of the present invention is to provide a digital scaler that can be used in combination with a drafting instrument comprising a main right triangle slidable along a horizontal edge of a drafting table, a slidable right triangle slidably engaged with a vertical straight edge of the main right triangle, and drive means connected between the main right triangle and the slidable right triangle for effecting the relative movement between the two triangles. The digital scaler provides a digital readout of any horizontal displacement of the main right triangle on the horizontal edge of a drafting table and any vertical displacement of the slidable right triangle along the vertical straight edge of the main right triangle.

A further object of the present invention is to provide a digital scaling device which is simple in design, rugged in construction, and economical to manufacture.

Other objects and features of the invention are pointed out in the following description in terms of the embodiments thereof which are shown in accompanying drawings. It is to be understood, however, that the drawings are for the purpose of illustration only and that the invention can be embodied otherwise without departing from the general principles thereof.

DESCRIPTION OF THE PREFERRED EMBODIMENT

Figure 2:
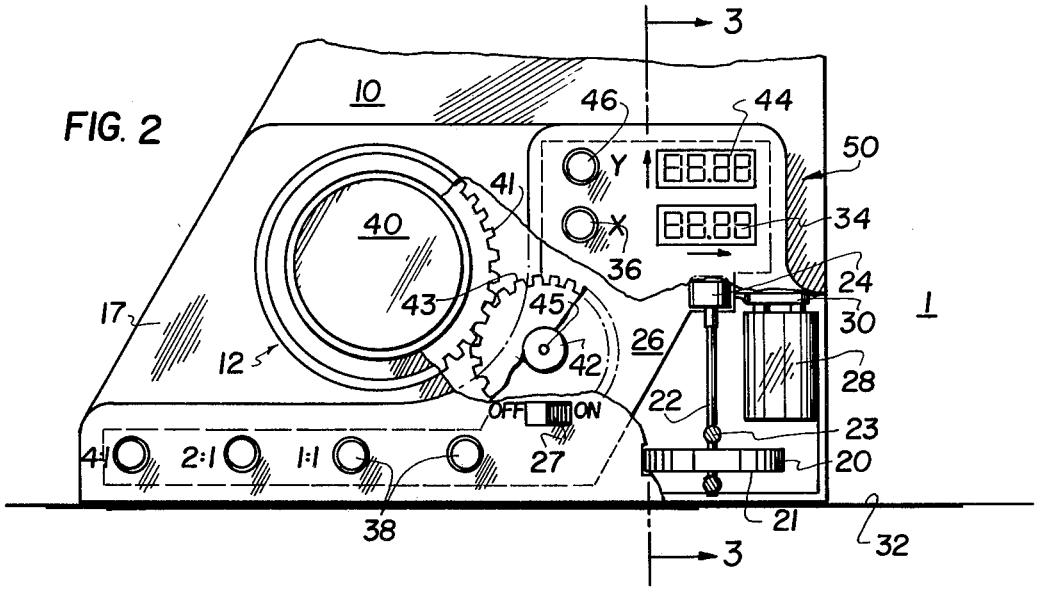
FIG. 2 is a top plan view of the embodiment shown in FIG. 1.
Figure 3:
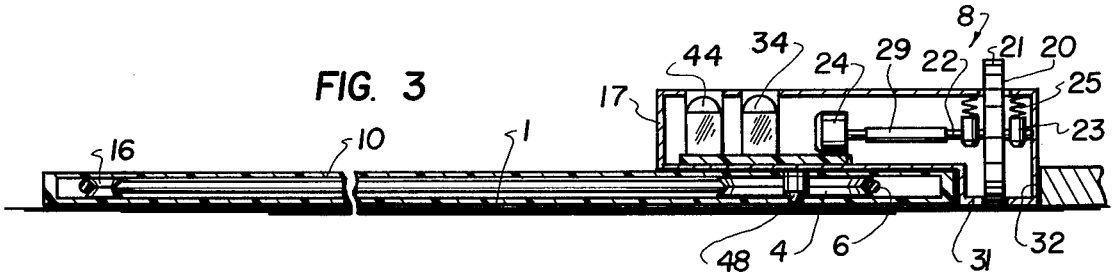
FIG. 3 is a side elevational view taken along lines 3—3 of FIG. 2.
Figure 1:
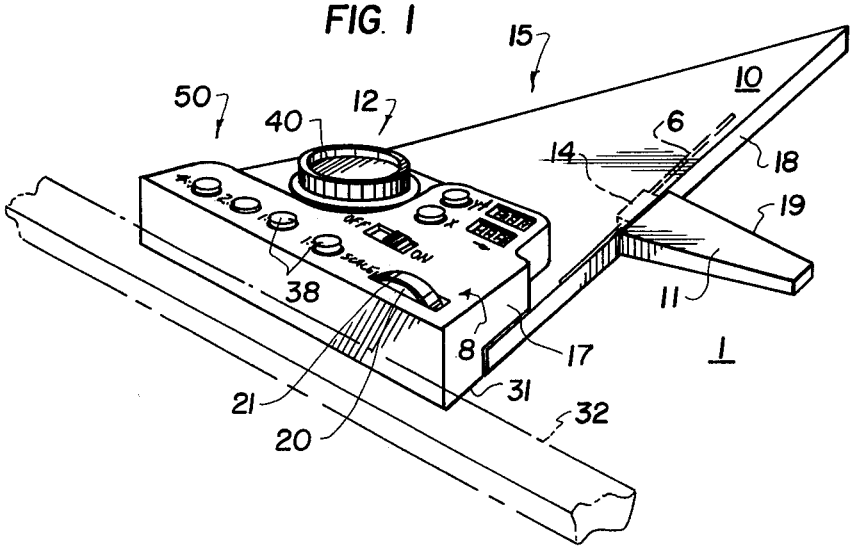
FIG. 1 is a top perspective view of one embodiment of the invention.

Referring now in particular to the drawings, a preferred embodiment of the invention is shown if FIG. 1 and comprises a digital scaler generally designated 50 which is utilized in conjunction with the Universal Drafting Triangle generally designated 15 or any other drafting instrument which provides the necessary degrees of freedom which are required for utilizing the digital scaler. The digital scaler 50 comprises a horizontal displacement measuring means generally designated 8 and a vertical displacement measuring means generally designated 12. These are encased within a housing 17 which may, for example, be made of a plastic or synthetic material. The Universal Drafting Triangle comprises a vertical straight edge means or first right triangle 10 which has a vertical straight edge 18 and which may be laid against the horizontal straight edge of a standard drafting table 32. A draftsman may slide the main triangle 10 horizontally across the straight edge 32, in a conventional manner, to position the vertical straight edge 18 as desired and draw any number of parallel vertical lines on the drafting surface 1. The horizontal displacement measuring means 8 includes a roller 20 which extends slightly below the lower surface 31 of the housing 17, and abuts against the drafting surface 1. As the digital scaler 50 with triangle 10, is moved or tracks horizontally across the straight edge 32 the roller 20 rotates. As best seen in FIGS. 2 and 3 roller 20 is mounted on a shaft 22 which is rotatably supported between a precision potentiometer 24 and bearings 23. Roller 20 may be provided with a sponge rubber covering 21 to insure a positive engagement between the roller 20 and the drafting surface 1. Alternatively or in addition to the rubber covering 21, the bearings 23 may be supported on the housing 17 by springs 25, and shaft 22 may be connected to precision potentiometer 24 through a flexible coupling 29 to provide a slight pivotal degree of freedom about potentiometer 24 to further enhance the positive engagement between the roller 20 and the drafting surface 1. Potentiometer 24 is electrically connected to a circuit board 26 in housing 17. Circuit board 26 is in turn connected to a digital display 34 through circuitry to be described later in accordance with FIG. 4. An X-zeroing switch 36 is also provided for zeroing the display on display 34, as are scale selection switches 38 for determining the scaler relationship between a horizontal displacement and the numerical display on display 34.

The vertical displacement measuring means 12 comprises a knob 40 which is rotatably mounted on housing 17. Knob 40 includes a stud or dowel portion 48 which extends downwardly into the triangle 10. Knob stud 48 engages with a drive means in the form of a drive roller 4 which is mounted in the triangle 10. Wrapped around the drive roller 4 is a drive belt or rubber O-ring 6 which is connected to a slide member 14 of a horizontal edge means in the form of a second triangle 11. Drive roller 4 is mounted in triangle 10 adjacent an angle thereof which is opposite the vertical straight edge 18. This, as shown in the drawings, permits a draftsman to operate the drive roller 4 with knob 40 for example in a position which is away from the straight edge 18 and triangle 11 to add in the convenience of operation of the device. Slide member 14 is slidably engaged within the triangle 10 and the rotation of drive-wheel 4 causes the displacement of the O-ring 6 within the triangle 10 which in turn causes the vertical displacement a tracking of the second triangle 11. Free rotating rollers such as 16 are also mounted within the triangle 10 to guide the drive belt 6 in accordance with the parent application for a Universal Drafting Triangle. Referring back to FIG. 2, knob 40 is conected to a vertical displacement gear 41 which is meshed with a Y-potentiometer gear 43. Gear 43 is in turn connected to a potentiometer shaft 45 of the Y-potentiometer 42. Potentiometer 42 is electrically connected to the circuit 26, which in turn is connected to a vertical displacement display 44 in a similar fashion to the horizontal displacement display 34. Also provided is a Y-zeroing 46 which is used in a similar manner of X-zeroing switch 36. The circuit 26 is supplied by a battery 28 and is switched on and off by an ON-OFF switch 27.

In operation, a draftsman actuates the circuit 26 by moving the ON-OFF switch 27 to the ON position. A scale is then selected by depressing one of the scale selector switches 38 which causes the displays 34 and 44 to display any horizontal or vertical displacement in desired units. The triangle 10 is then slid along the straight edge 32 to place the vertical straight edge 18 in a desired position on the drafting surface 1. The draftsman then depresses the X-zeroing switch 36 to cause a display of zero units to appear on the horizontal display 34. The draftsman may then slide the triangle 10 with the digital scaler 50 thereon along the straight edge 32 to a desired distance, for example, one centimeter on the drafting surface 1. Assuming the draftsman selected a selector switch 38 which corresponded to the metric system and to a scale of one centimeter equals one centimeter, the numerals 01.00 would appear on horizontal display 34. The device can be provided with a plus or minus indication to indicate whether the displacement of the triangle 10 was toward the left hand or the right hand direction. By displacing the triangle 10 in either direction the roller 20 is caused to rotate as it tracks along surface 1 thereby rotating the shaft 20 and in turn the precision potentiometer 24 which is connected through circuitry here and after to be described, which causes a numeral corresponding to the horizontal displacement to appear on the display 34.

The draftsman may then position the second triangle 11 at any desired vertical position above the straight edge 34. The draftsman then depresses the Y-zeroing switch 46 to cause a display of zero to appear on display 44. Now knob 40 may then be rotated to cause the rotation of drive-wheel 4 which is engaged therewith, and in turn the vertical displacement of the straight edge 19 on the second triangle 11 through the belt 6. Simultaneously with this motion the gear 41 which is meshed with the gear 42, causes the shaft 45 on the precision potentiometer 42 to rotate, thereby causing a numerical equivalent to the vertical displacement of the straight edge 19 to a appear on the display 44.

The device can therefore be used to plot the position of various lines to be drawn or to measure the distances between lines already existing on a drafting surface. The device can also be used for changing the scale of measurements taken from one drawing, to be reproduced. The usefulness and dversatility of the device is only limited by the imagination of the draftsman and provides a highly useful mechanism for the drafting art.

Figures 4, 5:
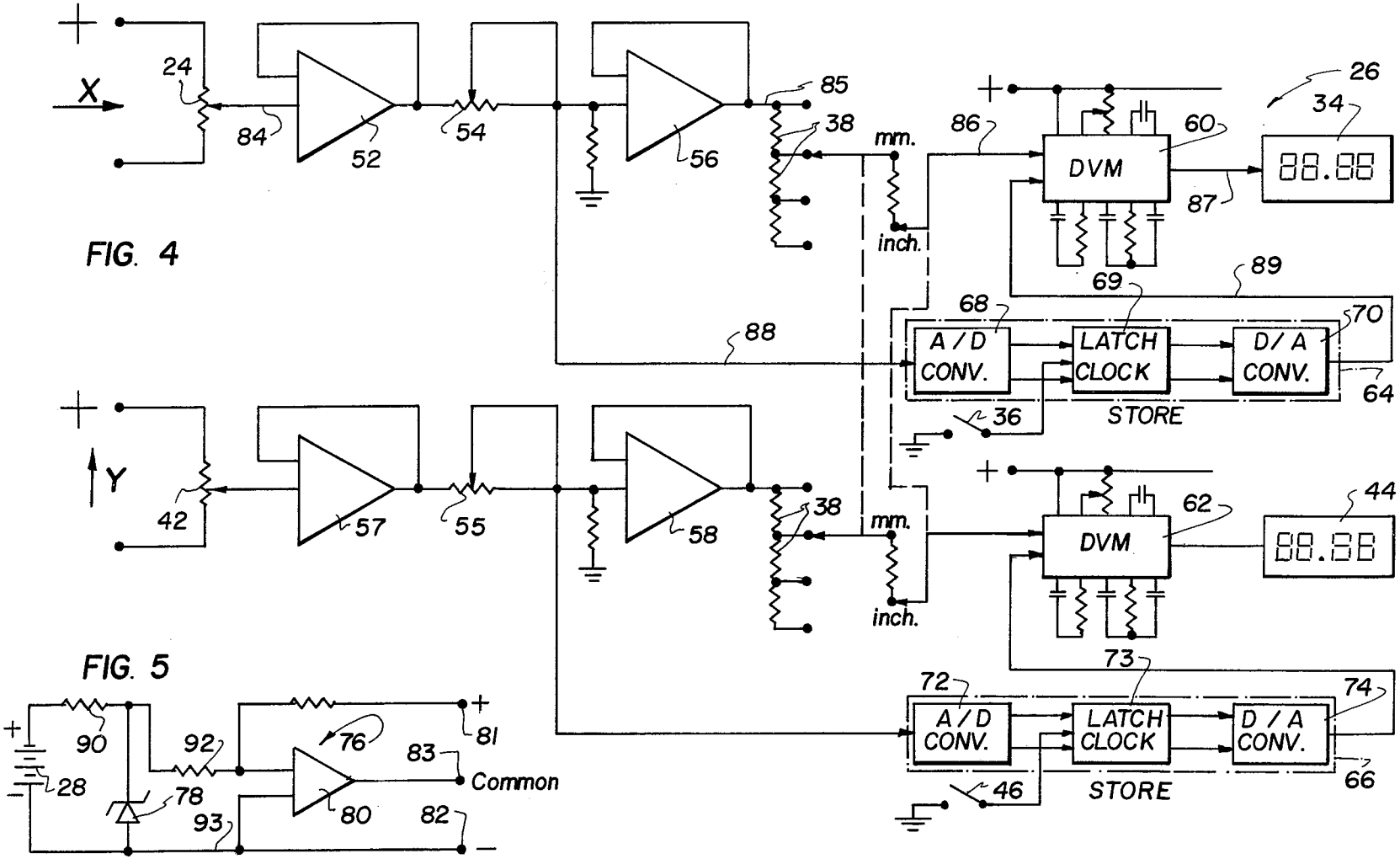
FIG. 4 is a schematic representation of the circuitry used in accordance with the invention.
FIG. 5 is a schematic representation of the power supply utilized in accordance with the invention.

Referring now to FIG. 4, an exemplory circuit usable to practice the invention is disclosed. Parts shown graphically in FIGS. 1 through 3 are shown schematically in FIGS. 4 and 5 and retain the same numerical designation. A precision potentiometer 24 is supplied with electrical power from a power supply to be later described in accordance with FIG. 5. The precision potentiometer may be for example a commerically available model from the Spectrol Company and is of a conventional configuration . The only requirement is that the potentiometer be extremely sensitive to slight rotation of its shaft in order to provide the necessary accuaracy to practice the invention. The potentiometer 24 includes a moving member connected through a line 84 to a first circuit 52. Buffer circuit 52 is connected through a scale adjuster 54 to a second buffer circuit 56. Adjuster 54 can be set internally of housing 17 to impress an overall scaling relationship between the potentiometer 24 and the display 34. Buffer 56 in turn is connected through a line 85 to the scale selector switches 38 which are mechanically connected and commonly movable for both the X and Y displacement apparatus. Selector switches 38 are connected through a line 86 to a digital voltage meter 60 for reading the digital voltage change caused by the rotation of the potentiometer 24 corresponding to a horizontal or X-direction displacement of the triangle 10. The meter 60 is then connected through a line 87 to digital display 34. The scale adjustment 54 is also connected to a storage 64 through a line 88.

Storage 64 comprises an analogue to digital converter 68 connected to a latch-clock or flip-flop 69 which in turn is connected to a digital to analogue converter 70. Connected to the latch-clock 69 is the X-zero adjustment switch 36 which impresses aninitial zero value to the digital display 34 through the digital to analogue converter 70 a line 89 the meter 60 and the line 87. The components disclosed are of conventional structure and are therefore shown in block diagram form which is sufficient to allow those skilled in the art to practice the invention.

The circuitry for the Y or vertical displacement portion of the invention is formed in a similar fashion and comprises the precision potentiometer 42, buffers, 57 and 58, scale adjustment 55, scale selective switch 38, a second digital voltage meter 62, digital display 44, and flip-flop or storage 66. Storage or flip-flop 66 comprises an analogue to digital converter 72, a latch clock 73 which is connected to the Y-zeroing switch 46, and a digital to analogue converter 74.

FIG. 5 discloses an example of a power supply usable in accordance with the invention and includes the battery 28 which is connected through a resistor 90 and a line 91 in parallel to a zener diode 78. Zener diode 78 is connected through a resistor 92 and a line 93 to an operational amplifier 80 to provide a common terminal 83, a positive terminal 81, and a negative terminal 82. The circuit as a whole comprise a power supply 76 which is utilized to drive the circuit 26 and cause the visual display of vertical and horizontal motion imparted on the potentiometers 24 and 42, on the digital displays 34 and 44 respectively.

The invention thus comprises a polytrack digital scale that can measure horizontal as well as vertical displacements of drafting edges on a drafting surface.

While a specific example of the invention has been disclosed and described in detail it should be understood that the invention can be embodied otherwise without departing from the principles of the invention.

What is claimed is:

1. A polytrack digital scale for measuring and displaying a distance on a drawing surface comprising, a first right triangle having a vertical straight edge, a second triangle having a horizontal straight edge connected to said first right triangle and slidably engaged with said vertical straight edge, drive means in said first right triangle connected to said second triangle for driving said second triangle with said horizontal straight edge along said vertical straight edge of said first triangle for vertically displacing said horizontal straight edge, a first precision potentiometer with a roller having a horizontal axis of rotation connected to said first potentiometer in said first triangle, said roller having a periphery engageable with the drawing surface for measuring a horizontal displacement of said first triangle on said drawing surface, a second precision potentiometer rotatable by said drive means and connected thereto for measuring a vertical displacement of said horizontal straight edge on said second triangle when said drive means drives said horizontal straight edge along said vertical straight edge, a first digital volt meter connected to said first potentiometer, a second digital volt meter connected to said second potentiometer and a digital display connected to each of said digital volt meters for displaying a digital representation of said vertical and horizontal displacement, said drive means comprising a drive roller rotatably mounted in said frist triangle about an axis substantially perpendicular to the drawing surface with a belt movable adjacent said vertical straight edge engaged around said drive roller, said drive roller connected to said second potentiometer, and said second triangle being connected to said belt, said drive roller rotatably mounted in said first triangle adjacent an angle thereof which is opposite said vertical straight edge.

2. A digital scale according to claim 1 wherein said second precision potentiometer is rotatable about an axis substantially parallel with that of said drive roller, a pair of gears connected connected respectively to said drive roller and said second potentiometer engaged with each other to rotate said second potentiometer with the rotation of said drive roller.

3. A digital scale according to claim 1 further comprising a knob connected to said drive roller for rotating said drive roller and displacing said horizontal straight edge.

4. A digital scale according to claim 1 wherein said digital display includes a first and second storage circuit connected between said first and second potentiometers and said first and second digital volt meters respectively and a display zeroing switch connected to each storage circuit.

5. A digital scale according to claim 1 wherein said digital display includes a scale selector switch connected to each digital volt meter for changing the units displayed on said digital display.

6. A digital scale according to claim 1 wherein said roller with horizontal axis has a sponge rubber covering for insuring a rotation of said roller when it moves over the drafting surface.

7. A digital scale according to claim 1 wherein said roller with a horizontal axis is mounted for rotation in a bearing and a spring is connected between said bearing and the rest of the digital scale to allow for a resilliant engagement between said roller and the drafting surface.

* * * * *